United States Patent [19]

Pfander

[11] Patent Number: 4,590,690

[45] Date of Patent: May 27, 1986

[54] ARTICLE OF FOOTWEAR AND METHOD OF MAKING SAME

[75] Inventor: Wilhelm Pfander, Brewer, Me.

[73] Assignee: Penobscot Shoe Company, Old Town, Me.

[21] Appl. No.: 768,702

[22] Filed: Aug. 23, 1985

[51] Int. Cl.[4] ..... A43B 13/28

[52] U.S. Cl. ..... 36/18; 36/12; 36/45; 12/142 C; 12/142 D

[58] Field of Search ..... 36/18, 47, 46.5, 45, 36/19 R, 12; 12/142 C, 142 D, 142 MC

[56] References Cited

U.S. PATENT DOCUMENTS

| | | | |
|---|---|---|---|
| 14,617 | 3/1919 | Cavanagh | 12/142 D |
| 391,025 | 10/1888 | Coombs | 36/57 |
| 1,922,051 | 8/1933 | Lapidus | 36/45 |
| 2,519,108 | 8/1950 | Bryant | 36/12 |
| 2,535,560 | 12/1950 | Barr | 36/45 |
| 2,984,918 | 5/1961 | Glassman | 36/46.5 |
| 3,135,060 | 6/1964 | McConnell | 36/57 |
| 3,204,346 | 9/1965 | Lockard | 36/101 |
| 3,259,931 | 7/1966 | Levenson | 36/142 MC |
| 4,023,283 | 5/1977 | Pfander | 36/142 MC |
| 4,034,431 | 7/1977 | Fukuoka | 12/142 MC |

FOREIGN PATENT DOCUMENTS

| | | | |
|---|---|---|---|
| 189230 | 9/1907 | Fed. Rep. of Germany | 36/46.5 |
| 2024601 | 1/1980 | United Kingdom | 36/19 R |

*Primary Examiner*—Werner H. Schroeder
*Assistant Examiner*—Mary A. Ellis
*Attorney, Agent, or Firm*—Quaintance, Murphy & Presta

[57] ABSTRACT

An article of footwear comprising a flexible elongated vamp or front upper member having a plurality of apertures along its ends, a flexible elongated quarter or rear upper member having a plurality of apertures along its ends, a notched innersole, a flexible socklining having an expanded shape, slits along both sides of the front and rear portions thereof, and a plurality of apertures along both sides of each of the slits. The front and rear upper members are inserted into the slits in the socklining and joined therewith to form a one-piece unit by passing a thread or the like through the apertures to form a seam at each point of insertion. The peripheral portion of the expanded socklining then is wrapped around and attached to an innersole which is notched to receive the raised handsewn seams at the proper locations. Each seam is located closely adjacent and substantially parallel to the "feather line" of the shoe, i.e., the line at which a sole portion is joined to the innersole.

7 Claims, 8 Drawing Figures

ARTICLE OF FOOTWEAR AND METHOD OF MAKING SAME

BACKGROUND OF THE INVENTION

The present invention relates to footwear, and more particularly, to a new and improved footwear construction and method of manufacture by which one or more upper members are joined to a socklining and then directly wrapped around a notched innersole, thereby eliminating the need for a separate wrapping strip.

California-wrap construction is a shoe-making process currently in use that produces footwear having excellent fitting and comfort qualities. These characteristics are achieved by stitching together an upper, a socklining, and a "wrapping strip" in a manner that then permits the strip to be wrapped, or lasted, onto an innersole. The fitting qualities are engineered into the upper pattern and are dependent upon accurate stitching, thereby eliminating the need for conventional lasting. In addition, the joining of the upper and socklining by stitching creates a one-piece "cavity" that is comfortable on the foot. A last is slipped into this cavity without the need for conventional lasting methods, and the footwear is then finished by traditional methods.

The present invention eliminates the need for the wrapping strip and the imprecision of construction often related to the seaming by which it and the upper portions are attached to the socklining. The present invention substitutes the attractiveness, improved fit and added precision of pre-engineered handsewn seams, thereby not only retaining but enchancing and insuring the superior features of the California-wrap construction.

SUMMARY OF THE INVENTION

The footwear and manufacturing method of the present invention retains the fit and comfort associated with the California-wrap construction, while eliminating the need for a separate wrapping strip. In addition, the method of the present invention inherently enhances the overall appearance of the footwear by permitting genuine handsewn seams.

The footwear of the present invention generally is constructed by inserting and sewing an upper portion into an expanded and slotted socklining which is then directly wrapped onto a pre-notched innersole. The upper portions and slotted portions of the socklining are provided with apertures to both facilitate hand-sewing and insure precise locations of the seams and fitting points during the wrapping process. This novel construction and method eliminates the need for an additional wrapping strip to be secured to the socklining, and creates the comfortable one-piece "cavity" that is characteristic of the California-wrap construction. Furthermore, the upper is enhanced by handsewn seams located just above the "feather line" of the footwear. By the utilization of pre-engineered apertures for creating the handsewn seams and pre-notched innersoles, the present invention insures heretofore unattainable accuracy of seaming and wrapping locations as required for improved fitting qualities.

DESCRIPTION OF THE PREFERRED EMBODIMENT

Figure 1:
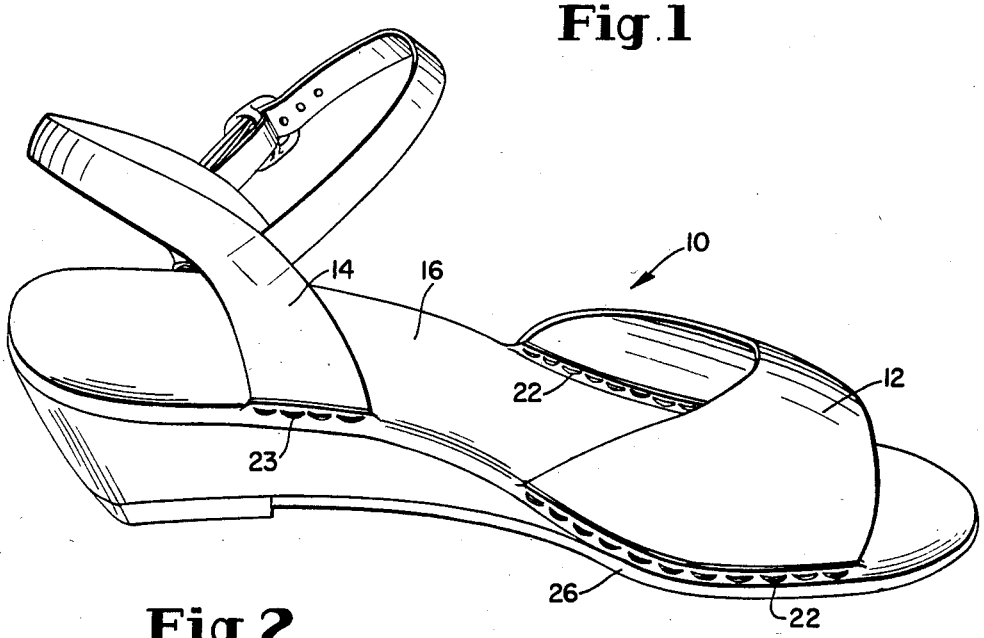
FIG. 1 is a perspective view of an article of footwear, such as a sandal, constructed in accordance with the principles of the present invention.

FIG. 1 illustrates a shoe such as a sandal 10 which is constructed in accordance with the principles of the present invention. The shoe 10 generally comprises a vamp or front upper portion 12, a quarter or rear upper portion 14, an innersole 24 and a socklining 16 formed of any suitable flexible materials, such as leather.

Figure 5:
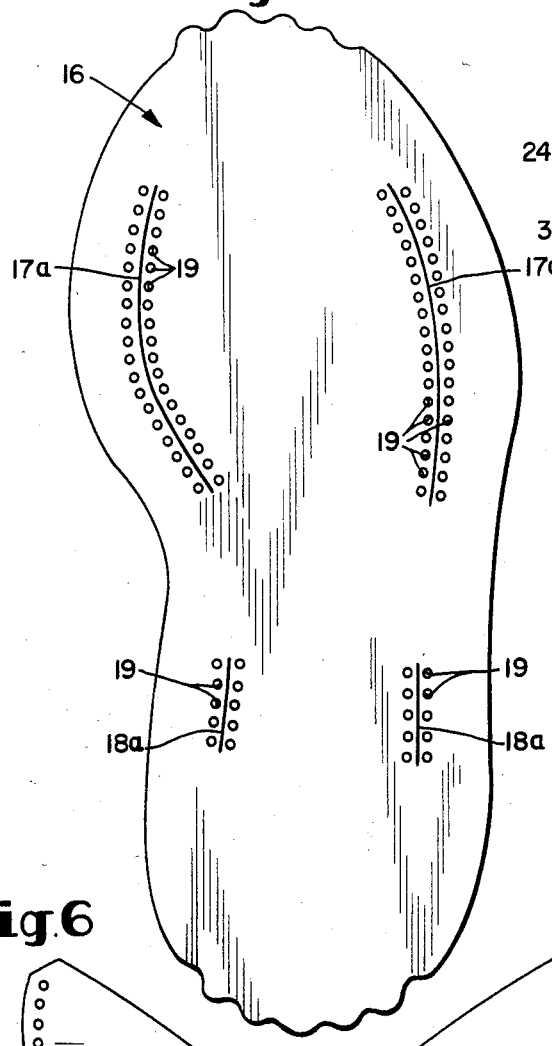
FIG. 5 is a top plan view of an expanded socklining of the present invention, revealing the slits and apertures therein prior to insertion of the upper portions and attachment to the innersole.
Figure 6:
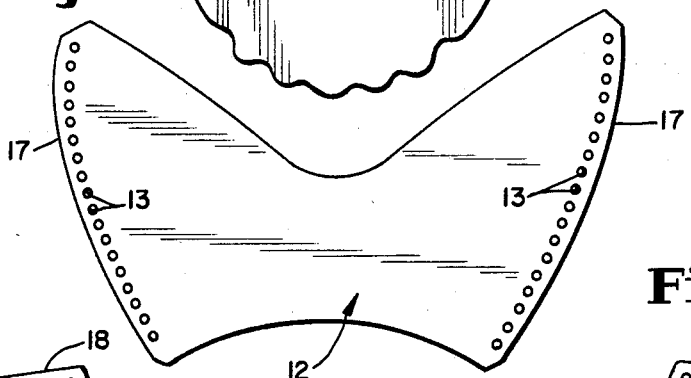
FIG. 6 is a bottom plan view of the vamp or front upper portion of the present invention, revealing the apertures therein prior to attachment to the socklining.
Figure 7:
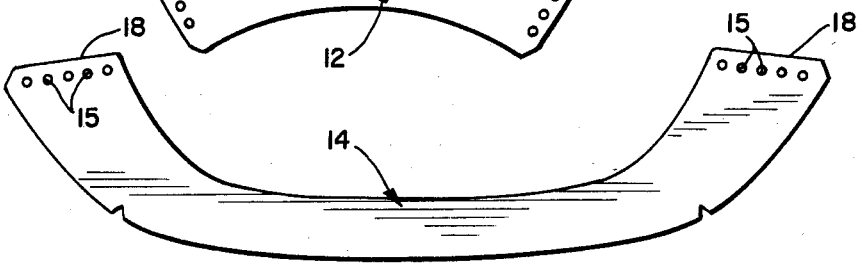
FIG. 7 is a plan view of the quarter or rear upper portion of the present invention, revealing the apertures therein prior to attachment to the socklining.

As shown in FIG. 5, the socklining 16 is expanded and formed with pairs of slits 17*a* and 18*a* near the side portions thereof into which the ends of the front upper portion 12 and rear upper portion 14 are inserted. A plurality of apertures 19 are substantially uniformly spaced along both sides of the slits 17*a* and 18*a*. As illustrated in FIG. 6, the front upper portion 12 in a flat configuration is generally V-shaped with apertures 13 substantially uniformly spaced along each end 17 thereof. The rear upper portion 14 shown in FIG. 7 has an elongated U-shape in flat configuration with apertures 15 substantially uniformly spaced along each end 18 thereof.

In accordance with the method of the present invention, the ends 17 of the front upper portion are inserted into the corresponding slits 17*a* in the socklining 16. Similarly, the ends 18 of the rear upper portion 14 are inserted into the corresponding slits 18*a* in the socklining 16. It is noted that the slits 17*a* and 18*a* are generally parallel to the adjacent outer periphery of the socklining 16 and are of a length that generally corresponds to that of the ends 17 of the front upper portion 12 and the ends 18 of the rear portion 14, respectively.

Figure 2:
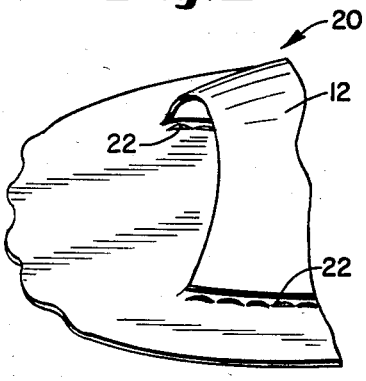
FIG. 2 is a partial top view in perspective of the attached front upper portion and socklining of the sandal shown in FIG. 1, revealing the seams therebetween.
Figure 3:
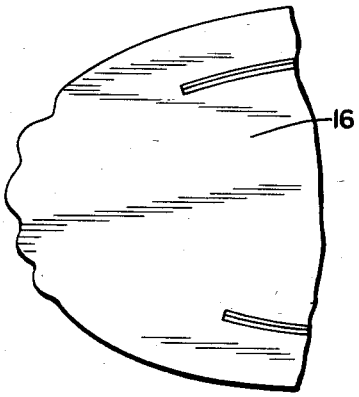
FIG. 3 is a partial bottom plan view of the attached front upper portion and socklining shown in FIG. 2.

The front upper portion 12, rear upper portion 14, and socklining 16 are than hand sewn together by passing a thread or other suitable means through the adjacent apertures 13 and 19, and apertures 15 and 19, to form seams 22, 23 between the front and rear upper portions 12, 14 and the socklining 16, wherein the ends of the upper portions are disposed between upturned edges of the socklining surrounding the slits 17*a*, 18*a*, as shown in FIGS. 1 and 2.

Figure 4:
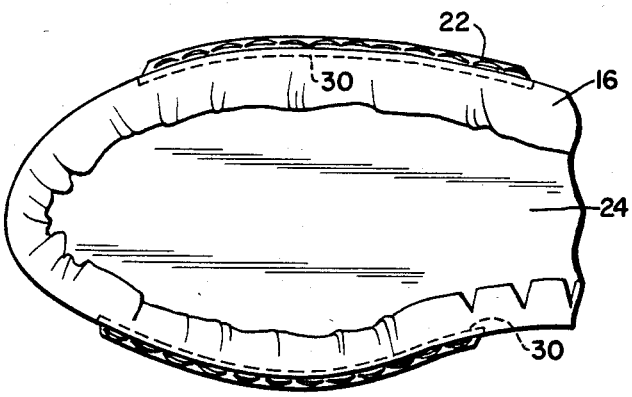
FIG. 4 is a bottom view of the attached front upper portion and socklining, showing a stage of the manufacturing method wherein the socklining is wrapped around and attached to an innersole.
Figure 8:
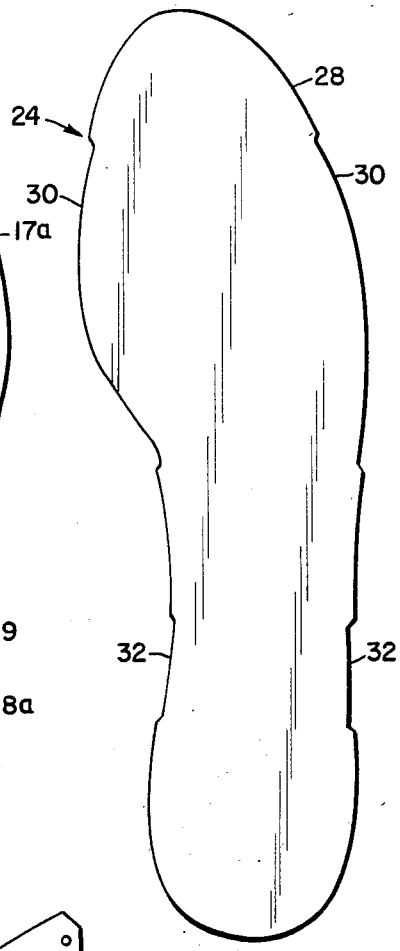
FIG. 8 is a top plan view of the notched innersole shown partially in FIG. 4.

The socklining 16 then is wrapped around and attached to the bottom of the innersole 24, as shown in FIG. 4. For the purpose of properly positioning the seams 22 and 23 when the socklining 16 is secured to the innersole 24, the periphery 28 of the innersole 24 is provided with notches 30 and 32 (FIG. 8) on both sides thereof which correspond generally in length to that of the seams 22 and 23, respectively. The notches 30, 32 also serve to provide adequate room or space for the seams 22, 23 when the socklining 16 is wrapped around and secured to the innersole 24. In this manner, the one-piece unit 20 partially shown in FIGS. 2 and 4 is formed with each seam 22, 23 located closely adjacent and substantially parallel to the edge of the innersole 24 to be joined to the sole 26 shown in FIG. 1. A last (not shown) then is inserted into the resulting one-piece unit 20, and the sole 26 is attached to the bottom of the innersole 24 using conventional methods.

As shown in FIG. 1, each seam 22, 23 is located adjacent and substantially parallel to the sole 26 of sandal 10. From the foregoing description, it will be readily apparent that the novel construction and method of the present invention enable the use of handsewn seams and eliminate the need for conventional lasting methods, while also eliminating the separate wrapping strip required by the California-wrap process. It is noted that the present invention is applicable to a footwear construction having any suitable or desired number of upper portions, such as one or more.

What is claimed is:

1. An article of footwear comprising a flexible elongated upper portion, a flexible socklining and an innersole; said upper portion having a plurality of apertures disposed near and substantially parallel to the ends thereof; said socklining having elongated slits therein near the sides thereof, said slits corresponding in number and generally in length to the ends of said upper portion; a plurality of apertures running along both sides of each of said slits; said upper portion being inserted into said slits to generally align said apertures in said upper portion with said apertures in said socklining; and means extending through said apertures to join said upper portion and said socklining at the points of insertion and form seams therebetween; said innersole having notches in the periphery thereof that correspond generally in length to that of said seams; the peripheral portion of said socklining being wrapped around and attached to said innersole with said seams being positioned in said notches; and a sole portion being joined to said innersole; said seams being located closely adjacent and substantially parallel to said sole portion.

2. The article of claim 1 wherein said upper portion and said socklining are formed of leather.

3. The article of claim 1 wherein said means extending through said apertures is thread.

4. The article of claim 1 wherein said apertures in said upper portion and socklining are substantially uniformly spaced therein.

5. The article of claim 1 wherein said slits are generally parallel to the adjacent outer periphery of said socklining.

6. A method of forming an article of footwear comprising the steps of:

forming a flexible elongated upper portion having a plurality of apertures disposed near and substantially parallel to its ends;

forming a flexible socklining having a pair of slits near the sides thereof, and a plurality of apertures running along both sides of each of said slits;

inserting the ends of said upper portion into said slits to generally align the apertures in said upper portion and said socklining;

joining said upper portion and said socklining by passing thread through said apertures to form seams therebetween;

wrapping the peripheral portion of said socklining around an innersole having notches in the periphery thereof and attaching it thereto so that said seams are positioned in said notches; and securing a sole portion to said innersole such that seams are positioned closely adjacent and substantially parallel to said sole portion.

7. The method of claim 6 wherein said thread is handsewn through said apertures.

* * * * *